US006349513B1

(12) United States Patent
Chen et al.

(10) Patent No.: US 6,349,513 B1
(45) Date of Patent: Feb. 26, 2002

(54) RAISED FLOOR SYSTEM FORMED OF OCTAGONAL PANELS

(75) Inventors: Wei Tran Chen; Hwa-Ching Hsu, both of Hsin-Chu (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/584,110

(22) Filed: May 31, 2000

(51) Int. Cl.[7] ..... E04B 5/00

(52) U.S. Cl. ..... 52/126.6; 52/263; 52/126.5; 52/283

(58) Field of Search ..... 52/263, 262, 126.5, 52/126.6, 220.1, 220.3, 220.8, 283

(56) References Cited

U.S. PATENT DOCUMENTS 4,558,544 A * 12/1985 Albrecht et al. ..... 52/126.6
4,578,910 A * 4/1986 Germeroth et al. ..... 52/105
5,333,423 A * 8/1994 Propst ..... 52/126.6
5,749,188 A * 5/1998 Belbenoit ..... 52/263

* cited by examiner

*Primary Examiner*—Beth A. Stephan
*Assistant Examiner*—Jennifer I. Thissell
(74) *Attorney, Agent, or Firm*—Tung & Associates

(57) ABSTRACT

A raised floor system constructed of octagonal panels for use in a semiconductor clean room facility is disclosed. In the raised floor system, a plurality of pedestals each having a top portion and a base portion threadingly engaged together for adjusting a height of the pedestal is first provided. The top portion of the pedestal has a square top surface and four recessed peripheral slots surrounding the top surface. Each of the four recessed peripheral slots being adapted for engaging an octagonal panel. The raised floor system further includes a plurality of octagonal panels each has a flat top surface and a convex bottom surface equipped with a raised peripheral ridge for engaging one of the recessed slots on the top portion of the pedestal such that the flat top surface of the octagonal panel is coplanar with the square top surface of the pedestal when the octagonal panel is mounted to the pedestal.

16 Claims, 6 Drawing Sheets

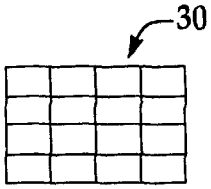
Figure 3A
Prior Art
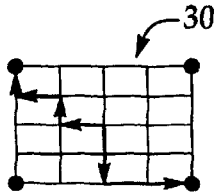
Figure 3B
Prior Art
30
| | | | | | | | | | | | | |
|---|---|---|---|---|---|---|---|---|---|---|---|---|
| 0.25 | 0.27 | 0.30 | 0.32 | 0.35 | 0.39 | 0.43 | 0.39 | 0.35 | 0.32 | 0.30 | 0.27 | 0.25 |
| 0.27 | 0.29 | 0.31 | 0.34 | 0.36 | 0.40 | 0.44 | 0.40 | 0.36 | 0.34 | 0.31 | 0.29 | 0.27 |
| 0.30 | 0.31 | 0.33 | 0.36 | 0.38 | 0.41 | 0.45 | 0.41 | 0.38 | 0.36 | 0.33 | 0.31 | 0.30 |
| 0.32 | 0.34 | 0.36 | 0.38 | 0.40 | 0.42 | 0.46 | 0.42 | 0.40 | 0.38 | 0.36 | 0.34 | 0.32 |
| 0.35 | 0.36 | 0.38 | 0.40 | 0.42 | 0.44 | 0.47 | 0.44 | 0.42 | 0.40 | 0.38 | 0.36 | 0.35 |
| 0.39 | 0.40 | 0.41 | 0.42 | 0.44 | 0.46 | 0.48 | 0.46 | 0.44 | 0.42 | 0.41 | 0.40 | 0.39 |
| 0.43 | 0.44 | 0.45 | 0.46 | 0.47 | 0.48 | 0.50 | 0.48 | 0.47 | 0.46 | 0.45 | 0.44 | 0.43 |
| 0.39 | 0.40 | 0.41 | 0.42 | 0.44 | 0.46 | 0.48 | 0.46 | 0.44 | 0.42 | 0.41 | 0.40 | 0.39 |
| 0.35 | 0.36 | 0.38 | 0.40 | 0.42 | 0.44 | 0.47 | 0.44 | 0.42 | 0.40 | 0.38 | 0.36 | 0.35 |
| 0.32 | 0.34 | 0.36 | 0.38 | 0.40 | 0.42 | 0.46 | 0.42 | 0.40 | 0.38 | 0.36 | 0.34 | 0.32 |
| 0.30 | 0.31 | 0.33 | 0.36 | 0.38 | 0.41 | 0.45 | 0.41 | 0.38 | 0.36 | 0.33 | 0.31 | 0.30 |
| 0.27 | 0.29 | 0.31 | 0.34 | 0.36 | 0.40 | 0.44 | 0.40 | 0.36 | 0.34 | 0.31 | 0.29 | 0.27 |
| 0.25 | 0.27 | 0.30 | 0.32 | 0.35 | 0.39 | 0.43 | 0.39 | 0.35 | 0.32 | 0.30 | 0.27 | 0.25 |
Figure 3C
Prior Art
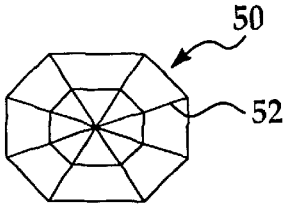
Figure 4A
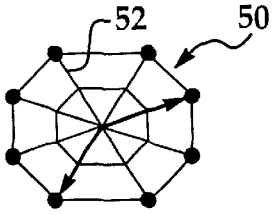
Figure 4B
50
| | | | | | | | | | | | | |
|---|---|---|---|---|---|---|---|---|---|---|---|---|
| | | | | 0.13 | 0.13 | 0.13 | 0.13 | 0.13 | | | | |
| | | | 0.13 | 0.14 | 0.14 | 0.14 | 0.14 | 0.14 | 0.13 | | | |
| | | 0.13 | 0.14 | 0.14 | 0.15 | 0.15 | 0.15 | 0.14 | 0.14 | 0.13 | | |
| | 0.13 | 0.14 | 0.14 | 0.15 | 0.16 | 0.16 | 0.16 | 0.15 | 0.14 | 0.14 | 0.13 | |
| 0.13 | 0.14 | 0.14 | 0.15 | 0.16 | 0.17 | 0.17 | 0.17 | 0.16 | 0.15 | 0.14 | 0.14 | 0.13 |
| 0.13 | 0.14 | 0.15 | 0.16 | 0.17 | 0.17 | 0.18 | 0.17 | 0.17 | 0.16 | 0.15 | 0.14 | 0.13 |
| 0.13 | 0.14 | 0.15 | 0.16 | 0.17 | 0.18 | 0.19 | 0.18 | 0.17 | 0.16 | 0.15 | 0.14 | 0.13 |
| 0.13 | 0.14 | 0.15 | 0.16 | 0.17 | 0.17 | 0.18 | 0.17 | 0.17 | 0.16 | 0.15 | 0.14 | 0.13 |
| 0.13 | 0.14 | 0.14 | 0.15 | 0.16 | 0.17 | 0.17 | 0.17 | 0.16 | 0.15 | 0.14 | 0.14 | 0.13 |
| | 0.13 | 0.14 | 0.14 | 0.15 | 0.16 | 0.16 | 0.16 | 0.15 | 0.14 | 0.14 | 0.13 | |
| | | 0.13 | 0.14 | 0.14 | 0.15 | 0.15 | 0.15 | 0.14 | 0.14 | 0.13 | | |
| | | | 0.13 | 0.14 | 0.14 | 0.14 | 0.14 | 0.14 | 0.13 | | | |
| | | | | 0.13 | 0.13 | 0.13 | 0.13 | 0.13 | | | | |
Figure 4C

POSITION MARK

| | | | | | | | | | | | | |
|---|---|---|---|---|---|---|---|---|---|---|---|---|
| 1 | 2 | 3 | 4 | 5 | 6 | 7 | 8 | 9 | 10 | 11 | 12 | 13 |
| 14 | 15 | 16 | 17 | 18 | 19 | 20 | 21 | 22 | 23 | 24 | 25 | 26 |
| 27 | 28 | 29 | 30 | 31 | 32 | 33 | 34 | 35 | 36 | 37 | 38 | 39 |
| 40 | 41 | 42 | 43 | 44 | 45 | 46 | 47 | 48 | 49 | 50 | 51 | 52 |
| 53 | 54 | 55 | 56 | 57 | 58 | 59 | 60 | 61 | 62 | 63 | 64 | 65 |
| 66 | 67 | 68 | 69 | 70 | 71 | 72 | 73 | 74 | 75 | 76 | 77 | 78 |
| 79 | 80 | 81 | 82 | 83 | 84 | 85 | 86 | 87 | 88 | 89 | 90 | 91 |
| 92 | 93 | 94 | 95 | 96 | 97 | 98 | 99 | 100 | 101 | 102 | 103 | 104 |
| 105 | 106 | 107 | 108 | 109 | 110 | 111 | 112 | 113 | 114 | 115 | 116 | 117 |
| 118 | 119 | 120 | 121 | 122 | 123 | 124 | 125 | 126 | 127 | 128 | 129 | 130 |
| 131 | 132 | 133 | 134 | 135 | 136 | 137 | 138 | 139 | 140 | 141 | 142 | 143 |
| 144 | 145 | 146 | 147 | 148 | 149 | 150 | 151 | 152 | 153 | 154 | 155 | 156 |
| 157 | 158 | 159 | 160 | 161 | 162 | 163 | 164 | 165 | 166 | 167 | 168 | 169 |

| | MAX STRESS | STANDARD DEVIATION | MODE |
|---|---|---|---|
| SQUARE RAISED FLOOR | 0.5000 | 0.0591 | 0.3973 |
| OCTAGONAL RAISED FLOOR | 0.1875 | 0.0157 | 0.1250 |

RAISED FLOOR SYSTEM FORMED OF OCTAGONAL PANELS

FIELD OF THE INVENTION

The present invention generally relates to a raised floor system used in a semiconductor fabrication facility and more particularly, relates to a raised floor system that is formed of octagonal panels mounted to square-topped pedestals that is capable of sustaining large deformation without collapsing.

BACKGROUND OF THE INVENTION

In the recent development of semiconductor fabrication technology, the continuous miniaturization in device fabricated demands more stringent requirements in the fabrication environment and contamination control. When the feature size was in the 2 μm range, a cleanliness class of 100~1000 (i.e., the number of particles at sizes larger than 0.5 μm per cubic foot) was sufficient. However, when the feature size is reduced to 0.25 μm, a cleanliness class of 0.1 is required. It has been recognized that an inert mini-environment may be the solution to future fabrication technologies when the device size is reduced further. In order to eliminate micro-contamination and to reduce native oxide growth on silicon surfaces, the wafer processing and the loading/unloading procedures of a process tool must be enclosed in an extremely high cleanliness mini-environment that is constantly flushed with ultra-pure nitrogen that contains no oxygen and moisture.

Different approaches in modern clean room design have been pursued in recent years with the advent of the ULSI technology. One is the utilization of a tunnel concept in which a corridor separates the process area from the service area in order to achieve a higher level of air cleanliness. Under the concept, the majority of equipment maintenance functions are conducted in low-classified service areas, while the wafers are handled and processed in more costly high-classified process tunnels. For instance, in a process for 16M and 64M DRAM products, the requirement of contamination control in a process environment is so stringent that the control of the enclosure of the process environment for each process tool must be considered. This stringent requirement creates a new minienvironment concept which is shown in FIG. 1. Within the enclosure of the minienvironment of a process tool 10, an extremely high cleanliness class of 0.1 (i.e., the number of particles at sizes larger than 0.1 μm per cubic foot) is maintained, in contrast to a cleanliness class of 1000 for the overall production clean room area 12. In order to maintain the high cleanliness class inside the process tool 10, the loading and unloading sections 14 of the process tool must be handled automatically by an input/output device such as a SMIF (standard mechanical interfaces) apparatus.

FIG. 1 also shows a raised floor system 30. The raised floor system 30 is normally installed between 45 and 60 cm above the finished concrete waffle slab 32. The raised floor system 30 generally, covers the entire clean room production area. The grid 34 of the raised floor is based on a 60×60 cm system and is normally aligned with the center lines of the filter ceiling grid. Some of the floor tiles 36 are perforated for circulating the clean room air 38. The adjustment of the air pressure in the clean room and the balancing of air flow can be achieved by selecting floor tiles with proper perforations.

In the raised floor system 30 shown in FIG. 1, the floor tiles 36 should be static-dissipative and made of non-combustible material that is also chemical abrasion resistance. A frequently used material is vinyl which is impact resistant and meets the electrostatic discharge isolation resistance requirement for the clean room environment.

A detailed, cross-sectional view of a raised floor system 30 is shown in FIG. 2. The raised floor system 30 should be laterally stable in all directions with or without the presence of the floor tiles 36. This is achieved by anchoring the pedestals 40 into the concrete slab floor 32 and by the further use of stringers 42 and steel braces 44. The floor tiles are supported by the stringers 42 which are in turn supported at each corner by adjustable height pedestals 40. As shown in FIG. 2, the pedestals 40 are bolted to the finished concrete waffle slab 32. An insulation plate 46 placed on top of each pedestal 40 attenuates foot-step sound and ensures electrical isolation. The steel braces 44 are used to further increase the rigidity of the raised floor system 30 and the pedestal support.

In recent years, for safety considerations such as for minimizing the risk from earthquake vibration in a highly stacked fab plant, screws or bolts are required at each corner of the raised floor panels 36. However, even with the screw attachments, a raised floor system 30 with square panels cannot be deformed to a large extent without collapsing or failure.

In a raised floor system that is formed of square or rectangular panels, as that shown in FIGS. 3 and 5, a force acting on one panel can only be transferred to one immediate adjacent panel (See FIG. 5) or through the boundaries between the panels to a support or a pedestal (See FIG. 3B). The result of a stress analysis for a conventional raised floor system utilizing rectangular panels is shown in FIG. 3. The data obtained for each panel is calculated by the equation of: Sigma=Fs+m=0.25 F+L * 0.25 F. The stresses calculated are significantly higher than a raised floor system equipped with octagonal panels shown in FIG. 4C.

In the conventional raised floor system equipped with square or rectangular panels, the force acting on one panel during an earthquake cannot be transmitted to all directions, instead only to one direction as shown in FIGS. 3B and 5. The large force, or stress transmitted to the next panel leads to possible cracking in the panel or in pedestal support system which may lead to a dislocation of process machines situated on the raised floor. The dislocation of the process machines may in turn cause breakage of conduits that feed corrosive or poisonous chemicals to the process machines and serious leakage and contamination problems in the fab facility.

SUMMARY OF THE INVENTION

It is therefore an object of the present invention to provide a raised floor system for a semiconductor clean room facility that does not have the drawbacks or shortcomings of conventional raised floor systems.

It is another object of the present invention to provide a raised floor system for a semiconductor clean room facility constructed of octagonal-shaped panels.

It is a further object of the present invention to provide a raised floor system for semiconductor clean room facility constructed of octagonal panels mounted on pedestals that have square top surfaces forming part of the floor.

It is still another object of the present invention to provide a raised floor system for semiconductor clean room facility equipped with octagonal panels having a raised peripheral ridge on a bottom side for mounting to recessed peripheral slots on pedestals.

It is still another object of the present invention to provide a raised floor system for semiconductor clean room facility that is constructed of octagonal panels each has a flat top surface and a convex bottom surface equipped with a raised peripheral ridge for engaging onto four pedestals.

It is yet another object of the present invention to provide a raised floor system for semiconductor clean room facility that is constructed of octagonal panels wherein a plurality of pedestals each has a top portion and a base portion threadingly engaged together for adjusting a height of the pedestal is used.

In accordance with the present invention, a raised floor system for use in a semiconductor clean room facility that is formed of octagonal-shaped panels and square-topped pedestals is provided.

In a preferred embodiment, a raised floor system constructed of octagonal panels is provided which includes a plurality of pedestals each has a top portion and a base portion threadingly engaged together for adjusting a height of the pedestal, the top portion has a square top surface and four recessed peripheral slots surrounding the top surface, each of the four recessed peripheral slots is adapted for engaging an octagonal panel, and a plurality of octagonal panels each has a flat topped surface and a convex bottom surface equipped with a raised peripheral ridge for engaging one of the recessed slots on the top portion of the pedestal such that the flat top surface of the octagonal panel is coplanar with the square top surface of the pedestal when the panel is assembled to the pedestal.

In the raised floor system constructed of octagonal panels, the octagonal panels each has an octagonal shape of equal sides. The top portion and the base portion of the pedestal threadingly engages each other by a screw shaft stationarily mounted in the base portion. The raised floor system may further include at least one height-adjusting collar that has female threads therein for engaging the screw shaft for supporting the top portion of the pedestal and for turning on the screw shaft for raising or lowering the top portion of the pedestal. The raised floor system may further include a locking collar that has female threads therein for engaging the screw shaft, the locking collar may be positioned on top and for locking a position for the at least one height-adjusting collar such that a height of the pedestal is locked.

In the raised floor system, the convex bottom surface of the plurality of octagonal panels may further include a plurality of rib sections for reinforcing a rigidity of the panels. The convex bottom surface of the plurality of octagonal panels may further include a plurality of rib sections arranged peripherally around a center of the panel, the rib sections may have a height of at least 0.5 cm. The plurality of pedestals and the plurality of octagonal panels may be fabricated of a high rigidity metal, such as aluminum or steel. The at least one height-adjusting collar may have a knurled section on an outer surface to facilitate gripping by human hand. The four recessed peripheral slots surrounding the top surface of the top portion of the pedestal each may have a depth of at least 2 cm for receiving the raised peripheral ridge of the octagonal panels. The raised peripheral ridge of the octagonal panels may have a height of at least 1 cm. A largest linear dimension on the octagonal panels is about 60 cm, a thickness of the octagonal panels is about 1 cm. The plurality of pedestals and the plurality of octagonal panels may be fabricated of aluminum.

BRIEF DESCRIPTION OF THE DRAWINGS

These and other objects, features and advantages of the present invention will become apparent from the following detailed description and the appended drawings in which:

FIG. 3 are graphs illustrating a stress analysis conducted on a conventional raised floor system equipped with square panels.

FIG. 4 are graphs illustrating a stress analysis conducted on the present invention raised floor system equipped with octagonal panels.

DETAILED DESCRIPTION OF THE PREFERRED EMBODIMENT

Figure 1:
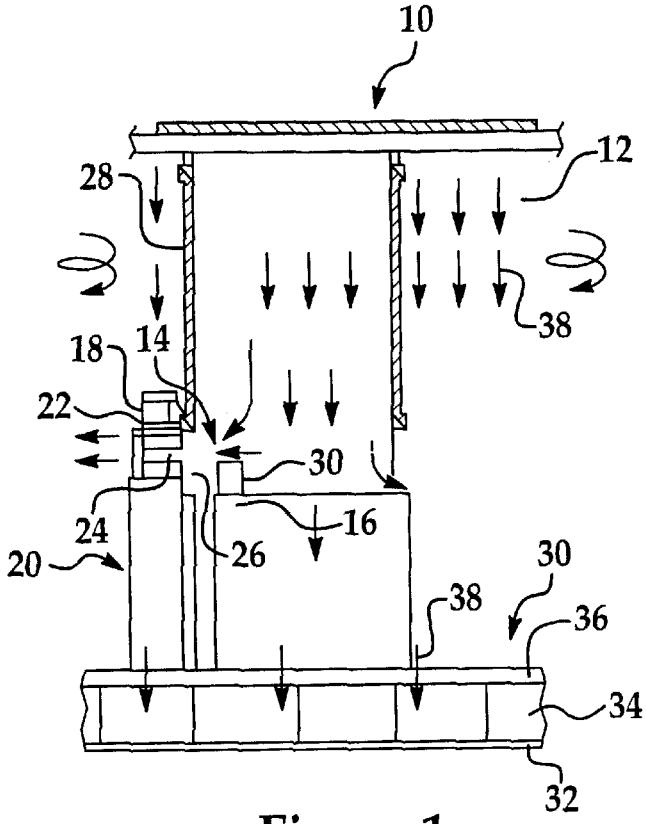
Figure 1 Prior Art
FIG. 1 is a cross-sectional view of a typical semiconductor clean room set-up with a process machine situated on a raised floor system.
Figure 2:
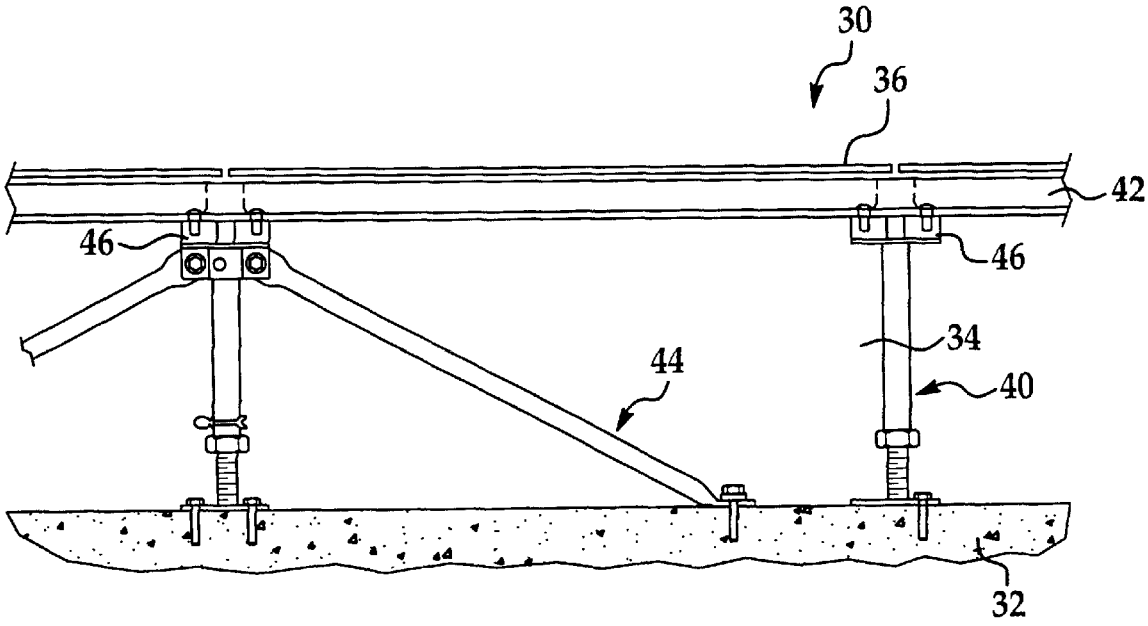
Figure 2 Prior Art
FIG. 2 is a cross-sectional view of a conventional raised floor system utilizing square or rectangular panels.

The present invention discloses a raised floor system that is formed of octagonal panels for a semiconductor clean room facility. The present invention raised floor system has greatly improved force transfer capability such that under a large deformation force, such as one that encountered in an earthquake, the force acting on one panel can be transmitted readily to other panels in all directions and thus avoiding a collapsing or rupturing of the octagonal panels or the dislocation of process machines situated on the raised floor system.

The present invention raised floor system can be constructed of octagonal panels mounted on a plurality of pedestals. Each pedestal has a top portion and a base portion threadingly engaged together for adjusting a height of the pedestal. The top portion of the pedestal has a square top surface and four recessed peripheral slots surrounding the top surface adapted for engaging an octagonal panel in each slot. The raised floor system further includes a plurality of octagonal panels each has a flat top surface and a convex bottom surface equipped with a raised peripheral ridge for engaging one of the recessed slots on the top portion of the pedestal such that the flat top surface of the octagonal panel is coplanar with the square top surface of the pedestal when the panels are mounted to the pedestal. Each panel, when in a mounted position, is supported by four pedestals that are spaced 90° apart. By using the present invention novel, the loading capacity of the raised floor system with the octagonal panels is improved by 30% over that of the conventional square panels. The structural integrity of the present invention novel pedestal is further improved by 50% over the conventional pedestal of circular cross-sectional area. The engagement method between the octagonal panels and the top of the pedestals further allows the dissipation of forces during an earthquake since the octagonal panels are allowed to move while the raised peripheral ridge on the panels engages the recessed peripheral slots on the pedestal. This is a great improvement over the conventional square panels which are bolted to the pedestals through the stringers.

The present invention novel panels and pedestals can be advantageously fabricated of a rigid metal, such as aluminum or steel. For weight saving and ease of machining reasons, the pedestals are normally fabricated of aluminum.

Referring now to FIG. 4 wherein FIG. 4A illustrates a bottom view of a present invention octagonal panel 50 showing the reinforcing ribs 52 shaped in a spider web. The force acting on the panel 50 can be advantageously distributed from the center to eight corners and therefore greatly facilitates stress distribution. The stress can be calculated by the equation: Sigma =Fs+m=0.125 F+L * 0.125 F. This is shown in FIG. 4B. A stress analysis for the present invention octagonal panel which shows greatly reduced stress levels when compared to that shown in FIG. 3C is shown in FIG. 4C.

Figure 5:
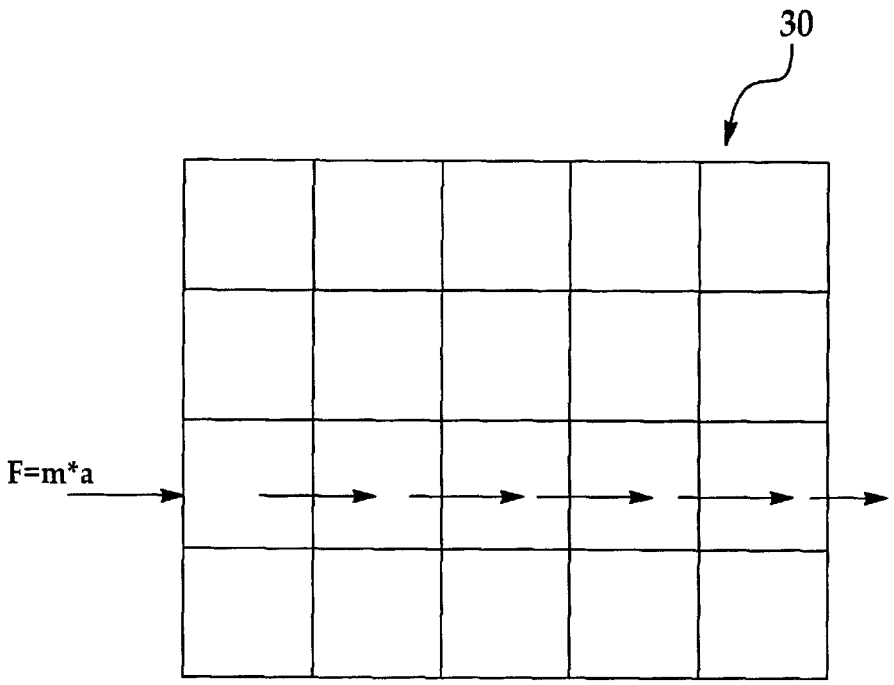
Figure 5 Prior Art
FIG. 5 is a plane view of a conventional raised floor system equipped with square panels illustrating the stress transfer pattern.
Figure 6:
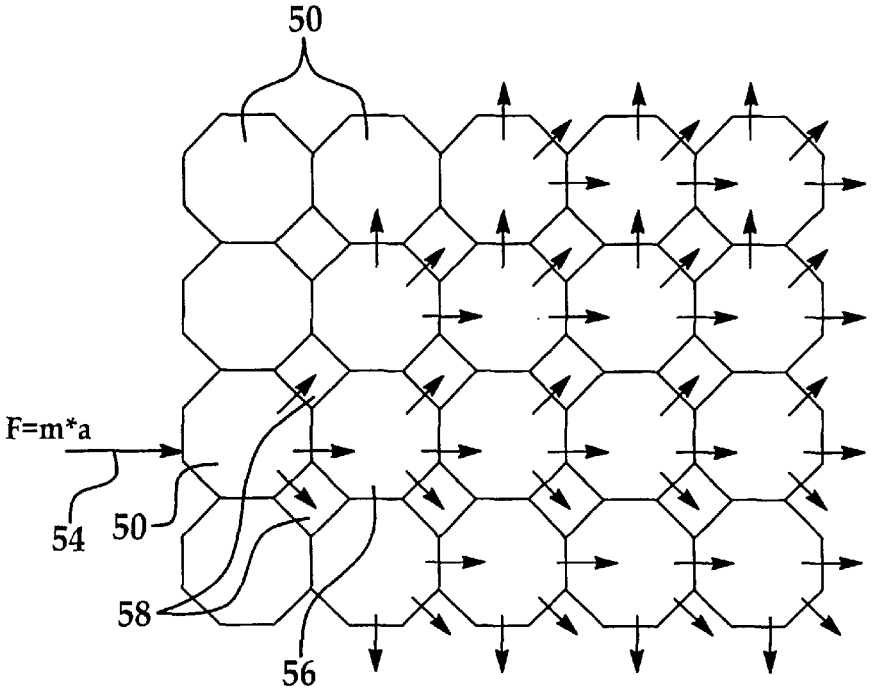
FIG. 6 is a plane view of the present invention raised floor system equipped with octagonal panels illustrating the force transfer pattern.

A more detailed diagram illustrating the stress distribution on the octagonal panels is shown in FIG. 6. A force 54 acting on an octagonal panel 50 can be distributed, as shown by the arrows, to at least three adjacent members, i.e., including an adjacent panel 56 and two adjacent pedestals 58. Based on the octagonal geometry of the panel 50, the force propagated to panel 56 which in turn transfers the force to three other adjacent members, etc. A more efficient force transfer is therefore achieved by the present invention octagonal panel 50, as shown in FIG. 6, when compared to the square panel 30 shown in FIG. 5.

Figures 7A, 7B, 7C:
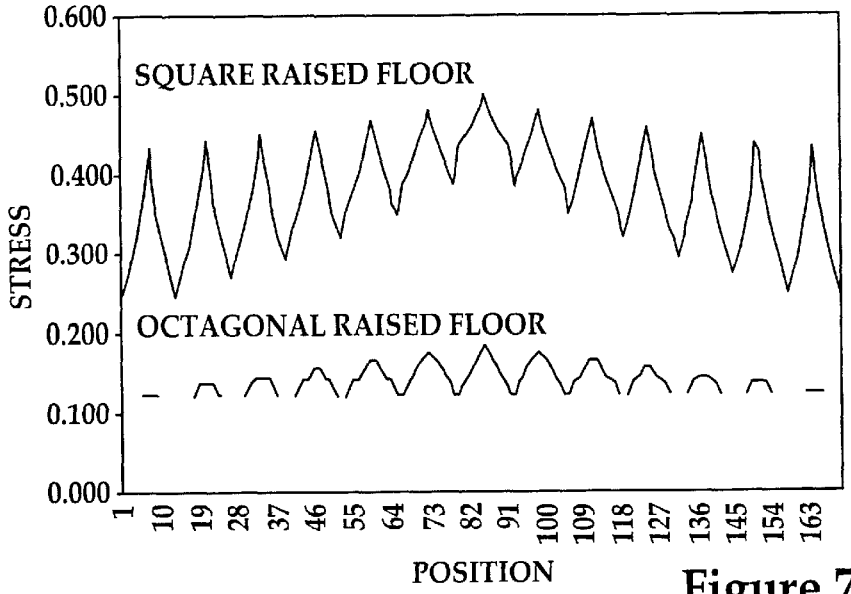
FIG. 7 are graphs illustrating a position map of stress (or force) between a conventional raised floor system and a present invention raised floor system.

FIG. 7 illustrates numerical calculations for the stress analysis based on the conventional square panels and the present invention octagonal panels. For instance, FIG. 7A illustrates the position marking system used for marking the square panels in the conventional setup for data shown in FIG. 7B. Similar marking method is used for the octagonal panel which is not shown in FIG. 7. As shown in FIG. 7B, the top curve indicates stress data obtained for the conventional square panels while the bottom curve indicates data obtained on the present invention octagonal panels. A significant stress reduction is thus achieved by the use of the present invention octagonal panels, i.e. to an extent of at least 50%. The stress applied in FIG. 7 is a vertical force applied on the raised floor system. Data shown in FIG. 7C further proves the efficiency of the present invention octagonal raised floor system wherein the maximum stress is reduced by approximately 60%.

Figure 8A:
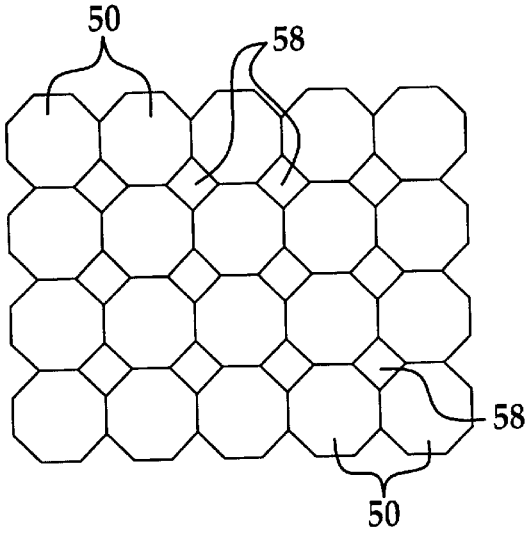
FIG. 8A is a plane view of the present invention raised floor system equipped with octagonal panels.
Figure 8B:
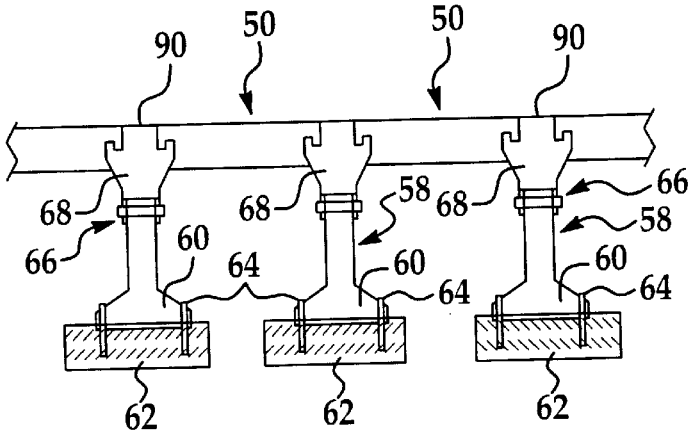
FIG. 8B is a cross-sectional view of a plurality of pedestals used in the present invention raised floor system.

Detailed structural views of the present invention pedestals are shown in FIGS. 8A~8D. FIG. 8A illustrates a plurality of the present invention octagonal panels 50 mounted to a plurality of pedestals 58. It is seen that each of the octagonal panel 50 is supported by four pedestals 58 that are situated 90° apart. A cross-sectional view of a plurality of the present invention pedestals 58 with the present invention octagonal panels 50 mounted on top are shown in FIG. 8B. Further shown in FIG. 8B are the base portions 60 of the pedestals 58 that are mounted to a concrete slab floor 62 by mechanical means such as bolts 64. A height adjusting means 66 is further used for adjusting the total height of the top portion 68 and the base portion 60.

Figure 8C:
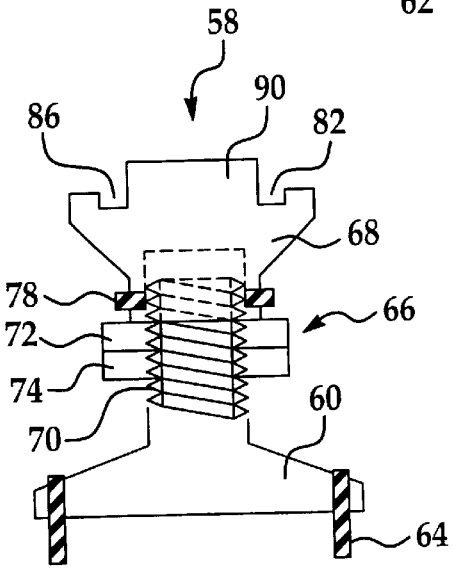
FIG. 8C is a cross-sectional view of a present invention pedestal illustrating the height adjustment means.

An enlarged view of the pedestal 58 including the height-adjusting means 66 is shown in FIG. 8C. The height-adjusting means 66 is constructed of a screw shaft 70 and two height-adjusting collars 72, 74 threadingly engaging the screw shaft 70. The screw shaft 70 may be advantageously mounted to the base portion 60 of pedestal 58 in a fixed manner, while the top portion 68 of the pedestal 58 is resting on the height-adjusting collar 72 and thus moving up and down with the collar 72. A knurled surface on the outer perimeter of the height-adjusting collars 72, 74 may further be provided to facilitate adjustment by human hand. The height-adjusting collars 72–74 are each provided with female threads on an internal diameter for engaging the screw shaft 70 such that when the collar 72, 74 is turned on the screw shaft 70, the top portion 68 of the pedestal 58 may be moved upwardly or downwardly. A locking collar 78 is further provided for engaging the screw shaft 70 by threads and for locking the height-adjusting collars 72 once a desirable height of the pedestal 58 is achieved.

Figure 8D:
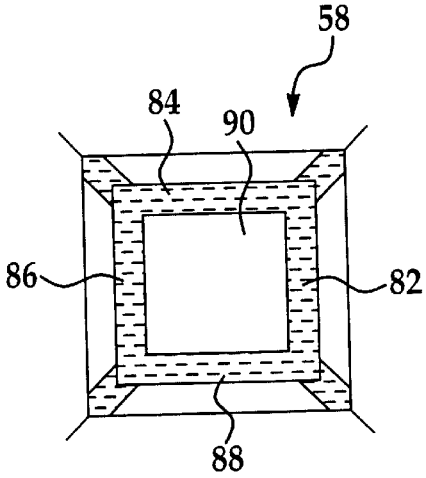
FIG. 8D is a top view of the top portion of the present invention pedestal illustrating the recessed slots for mounting the panels thereto.

A plane view of the top portion 68 illustrating recessed peripheral slots 82, 84, 86 and 88 are further shown in FIG. 8D. The center raised portion 90 is mounted flush with the octagonal panels 50, as shown in FIG. 8B. A suitable dimension for the recessed slots 82~88 is between about 0.5 cm and about 2 cm. The word "about" used in this writing means a range of values that is ±10% from the average value given. It should be noted that each of the recessed slots 82, 84, 86 and 88 is used to engage an octagonal panel 50.

Figure 9A:
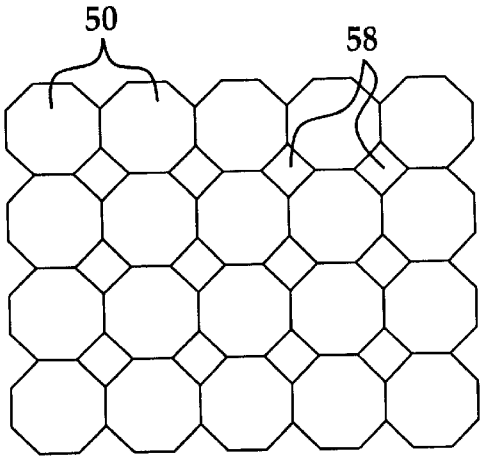
FIG. 9A is a plane view of the present invention raised floor system equipped with octagonal panels.
Figure 9B:
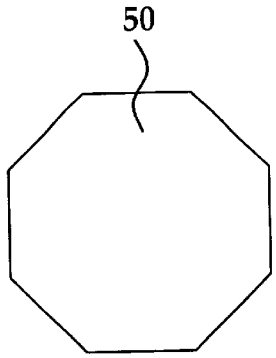
FIG. 9B is a plane view of a single octagonal panel used in the present invention raised floor system.
Figure 9C:
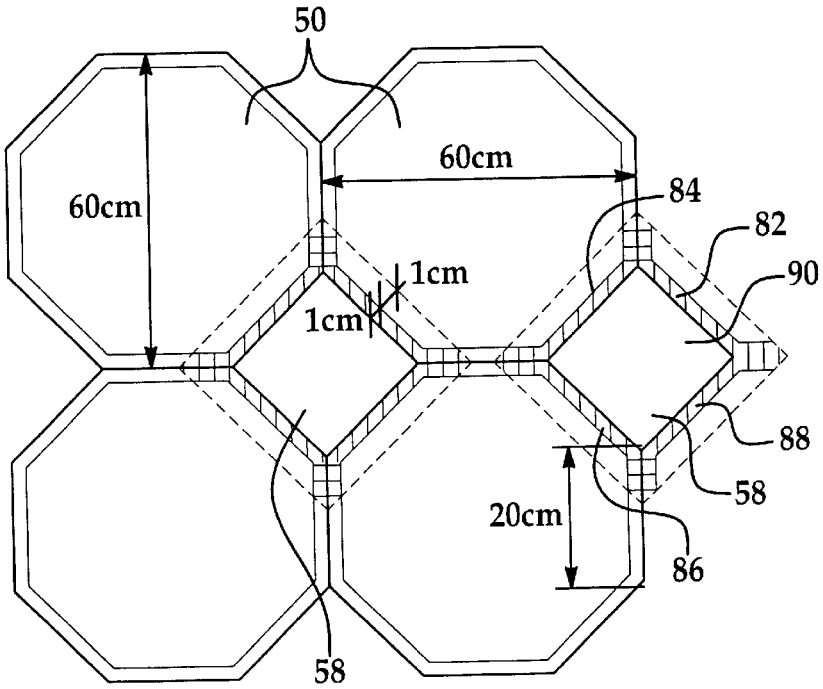
FIG. 9C is a plane view of a plurality of the present invention octagonal panels mounted to a plurality of pedestals.
Figure 9D:
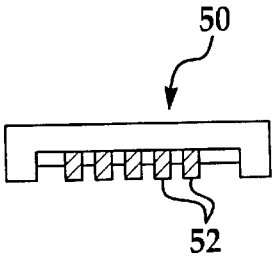
FIG. 9D is a cross-sectional view of a present invention octagonal panel illustrating the reinforcing ribs on the bottom side.
Figure 9E:
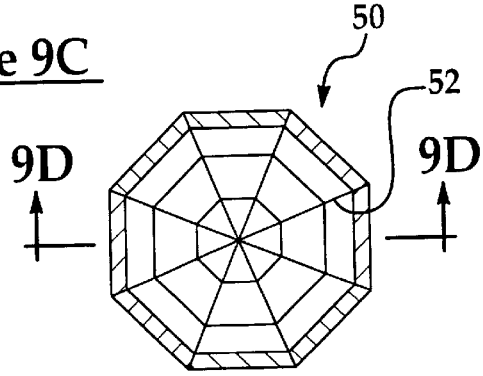
FIG. 9E is a bottom view of a present invention octagonal panel illustrating the reinforcing ribs.

Detailed structures of the octagonal panels 50 are shown in FIGS. 9A–9E. FIG. 9A is a plane view of a plurality of octagonal panels 50 mounted on a plurality of pedestals 58. The octagonal panel 50, shown in FIG. 9B, has eight equal sizes spaced apart equally. The mounting of the plurality of octagonal panels 50 to the plurality of pedestals 58 is shown in FIG. 9C wherein recessed slots 84 and 86 are engaged by two octagonal panels 50 respectively. A cross-sectional view of an octagonal panel 50 illustrating the reinforcing ribs 52 is shown in FIG. 9D. A bottom view of the octagonal panel 50 which further illustrates the reinforcing ribs 52 is shown in FIG. 9E.

The present invention raised floor system constructed of octagonal panels and pedestals having adjustable height have therefore been amply described in the above description and in the appended drawings of FIGS. 4, 6–9E.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A raised floor system constructed of octagonal panels comprising:

a plurality of pedestals each having a top portion and a base portion threadingly engaged together, a square top surface and four recessed peripheral slots surrounding said top surface, each of said four recessed peripheral slots being adapted for engaging an octagonal panel, and a plurality of octagonal panels each having a flat top surface and a convex bottom surface equipped with a raised peripheral ridge for engaging one of said recessed slots on said top portion of said pedestal such that said flat top surface of said octagonal panel is coplanar with said square top surface of said pedestal when said panel is assembled to said pedestal.

2. A raised floor system constructed of octagonal panels according to claim 1, wherein said octagonal panels each having an octagonal shape of equal sides.

3. A raised floor system constructed of octagonal panels according to claim 1, wherein said top portion and said base portion of the pedestal threadingly engage each other by a screw shaft mounted in said base portion.

4. A raised floor system constructed of octagonal panels according to claim 3 further comprising at least one height-adjusting collar having female threads therein for engaging said screw shaft for supporting said top portion of said pedestal and for turning on said screw shaft for raising or lowering said top portion of the pedestal.

5. A raised floor system constructed of octagonal panels according to claim 4, further comprising a locking collar having female threads therein for engaging said screw shaft, said locking collar being positioned on top for locking a position of said at least one height adjusting collar such that a height of said pedestal is locked.

6. A raised floor system constructed of octagonal panels according to claim 1, wherein said convex bottom surface of said plurality of octagonal panels further comprises a plurality of rib sections for reinforcing a rigidity of said panels.

7. A raised floor system constructed of octagonal panels according to claim 1, wherein said convex bottom surface of said plurality of octagonal panels further comprises a plurality of rib sections arranged peripherally around a center of said panel.

8. A raised floor system constructed of octagonal panels according to claim 1, wherein said convex bottom surface of said plurality of octagonal panels further comprises a plurality of rib sections each having a height of at least 0.5 cm.

9. A raised floor system constructed of octagonal panels according to claim 1, wherein said plurality of pedestals and said plurality of octagonal panels are fabricated of a high rigidity metal.

10. A raised floor system constructed of octagonal panels according to claim 1, wherein said plurality of pedestals and said plurality of octagonal panels are fabricated of a high rigidity metal of aluminum or steel.

11. A raised floor system constructed of octagonal panels according to claim 1, wherein said at least one height-adjusting collar having a knurled section on an outer surface to facilitate gripping by human hand.

12. A raised floor system constructed of octagonal panels according to claim 1, wherein said four recessed peripheral slots surrounding said top surface of said top portion of the pedestal each having a depth of at least 2 cm for receiving said raised peripheral ridge on said octagonal panels.

13. A raised floor system constructed of octagonal panels according to claim 12, wherein said raised peripheral ridge on said octagonal panels having a height of at least 1 cm.

14. A raised floor system constructed of octagonal panels according to claim 1, wherein a largest linear dimension on said octagonal panels is about 60 cm.

15. A raised floor system constructed of octagonal panels according to claim 1, wherein a thickness of said octagonal panels is about 1 cm.

16. A raised floor system constructed of octagonal panels according to claim 1, wherein said plurality of pedestals and said plurality of octagonal panels are fabricated of aluminum.

* * * * *